US008993862B2

(12) United States Patent
Anderson

(10) Patent No.: US 8,993,862 B2
(45) Date of Patent: Mar. 31, 2015

(54) RETRACTABLE STRINGED MUSICAL INSTRUMENTS AND METHOD FOR OPERATING SAME

(71) Applicant: Marc Eugene Anderson, Jamaica, NY (US)

(72) Inventor: Marc Eugene Anderson, Jamaica, NY (US)

( * ) Notice: Subject to any disclaimer, the term of this patent is extended or adjusted under 35 U.S.C. 154(b) by 0 days.

(21) Appl. No.: 14/204,526

(22) Filed: Mar. 11, 2014

(65) Prior Publication Data

US 2014/0260889 A1 Sep. 18, 2014

Related U.S. Application Data

(60) Provisional application No. 61/782,653, filed on Mar. 14, 2013.

(51) Int. Cl.

| | |
|---|---|
| ***G10D 3/00*** | (2006.01) |
| ***G10D 3/06*** | (2006.01) |
| ***G10D 1/00*** | (2006.01) |
| ***G10D 3/04*** | (2006.01) |

(52) U.S. Cl.
CPC .. *G10D 3/06* (2013.01); *G10D 1/00* (2013.01); *G10D 3/04* (2013.01)
USPC ..... 84/293

(58) Field of Classification Search
USPC ..... 84/267, 290, 293
See application file for complete search history.

(56) References Cited

U.S. PATENT DOCUMENTS

| | | | |
|---|---|---|---|
| 3,705,962 | A | 12/1972 | Banister |
| 4,760,767 | A | 8/1988 | Tsurubuchi |
| 4,987,816 | A | 1/1991 | Poor |
| 5,277,094 | A | 1/1994 | Spuler |
| 6,084,165 | A | 7/2000 | Chapman |
| 6,293,485 | B1 | 9/2001 | Hollowed |
| 7,084,337 | B1 | 8/2006 | Schroeder |
| 7,332,665 | B2 | 2/2008 | Haney |
| 7,355,110 | B2 | 4/2008 | Nash |
| 7,368,646 | B2 | 5/2008 | Payung |
| 7,544,878 | B2 | 6/2009 | Mishima et al. |
| 7,576,274 | B1 | 8/2009 | Frisch et al. |

(Continued)

FOREIGN PATENT DOCUMENTS

| | | | |
|---|---|---|---|
| EP | 0801781 | B1 | 10/1997 |
| EP | 0951748 | B1 | 10/1999 |
| 7,592,529 | | B2 | 9/2009 Tamura |

(Continued)

OTHER PUBLICATIONS

CR Series Violin, [Retrieved from the internet URL: <http://thinkns.com/instruments/violin.php>], 2 pages, retrieved on Apr. 2, 2014.

(Continued)

*Primary Examiner* — Kimberly Lockett
(74) *Attorney, Agent, or Firm* — Wilmer Cutler Pickering Hale and Dorr LLP

(57) ABSTRACT

The present invention is directed a retractable stringed musical instrument, and more particularly, to a stringed musical instrument having a tailpiece, a body coupled to the tailpiece, a neck coupled to the body and a fingerboard coupled to the neck. The fingerboard and the neck adjustably extendable and retractable relative to the tailpiece. The retractable stringed instrument further comprises a bridge coupled to the body where the bridge vertically movable upon retraction of the fingerboard and the neck to enable the fingerboard to move over the bridge.

27 Claims, 10 Drawing Sheets

(56) References Cited

U.S. PATENT DOCUMENTS

| | | | | |
|---|---|---|---|---|
| 7,687,695 | B2 | 3/2010 | DeJule | |
| 7,795,516 | B2 | 9/2010 | Toone | |
| 7,816,592 | B2 | 10/2010 | Babicz | |
| 7,825,313 | B2 | 11/2010 | Shaffer | |
| 7,847,169 | B2 | 12/2010 | Umeda | |
| 7,872,185 | B1 | 1/2011 | Chadwick | |
| 7,902,442 | B2 | 3/2011 | Leach | |
| 7,915,505 | B2 | 3/2011 | Miniaev | |
| 7,947,885 | B2 | 5/2011 | Klanner | |
| 8,084,678 | B2 | 12/2011 | McMillen et al. | |
| 8,106,288 | B2 | 1/2012 | Shaffer | |
| 8,110,729 | B2 | 2/2012 | Guthrie et al. | |
| 8,124,863 | B2 | 2/2012 | Van Wagoner | |
| 8,273,974 | B1 * | 9/2012 | Gonzalez | 84/293 |
| 2010/0199829 | A1 * | 8/2010 | Kamensky | 84/264 |

FOREIGN PATENT DOCUMENTS

| | | | |
|---|---|---|---|
| EP | 1290673 | B1 | 3/2003 |
| EP | 1705639 | A1 | 9/2006 |

OTHER PUBLICATIONS

Elderly Instruments, "Wipl Stix Travel Violin." [Retrieved from the internet URL: <http://www.elderly.com/new_instruments/items/STIX2.htm>], 1 page, retrieved on Feb. 20, 2013.

The Violin Site, "Violin Pickups", [Retrieved from the internet URL: <http://www.theviolinsite.com/violin_pickups.html>], 4 pages, retrieved on Apr. 2, 2014.

Vent Workshop, "Praxis, a travel violin," [Retrieved from the internet URL: <http://www.ventworkshop.com/praxis.html>], 1 page, retrieved on Feb. 20, 2013.

Wikipedia, "Cittern", [Retrieved from the internet URL: <http://en.wikipedia.org/wiki/Cittern>], 4 pages, retrieved on Apr. 2, 2014.

Wikipedia, "Kit violin", Retrieved from the internet URL: <http://en.wikipedia.org/wiki/Kit_violin>, 2 pages, retrieved on Apr. 2, 2014.

Wowee One speaker, [Retrieved from the internet URI: <http://www.woweeone.com/index.php?lang=us>], 1 page, retrieved on Apr. 2, 2014.

* cited by examiner

RETRACTABLE STRINGED MUSICAL INSTRUMENTS AND METHOD FOR OPERATING SAME

This application claims the benefit of U.S. Provisional Patent Application No. 61/782,653, filed Mar. 14, 2013, the contents of which are hereby expressly incorporated by reference herein in its entirety.

BACKGROUND

Technical Field

The disclosed subject matter relates generally to a retractable stringed musical instrument, and more particularly, to a stringed musical instrument having a portion that is capable of extending and retracting.

SUMMARY

Certain embodiments of the disclosed subject matter include a retractable stringed musical instrument. The retractable stringed instrument comprises a tailpiece, a body coupled to the tailpiece, a neck coupled to the body, and a fingerboard coupled to the neck. The fingerboard and the neck adjustably extendable and retractable relative to the tailpiece. The body disposed between the tailpiece and the fingerboard and the neck, and at least a portion of the neck disposed within the body in a retracted position. The retractable stringed instrument further comprises a bridge coupled to the body where the bridge vertically movable upon retraction of the fingerboard and the neck to enable the fingerboard to move over the bridge.

Certain embodiments of the disclosed subject matter include a retractable stringed musical instrument further comprising at least one tuning peg, a string stay and a plurality of strings distended between the tailpiece and the fingerboard, where the plurality of strings coupled to the tuning peg and the string stay.

Certain embodiments of the disclosed subject matter include a retractable stringed musical instrument, where the string stay coupled to the fingerboard or neck and the at least one tuning peg coupled to the tailpiece.

Certain embodiments of the disclosed subject matter include a retractable stringed musical instrument, where the string stay is coupled to the tailpiece and where the at least one tuning peg coupled to the fingerboard or the neck.

Certain embodiments of the disclosed subject matter includes a retractable stringed musical instrument that further comprises a string refraction mechanism for storing an excess length of at least one of the plurality of strings created upon retraction of the fingerboard and the neck.

Certain embodiments of the disclosed subject matter include a retractable stringed musical instrument that further comprises a chin rest coupled to the tailpiece where the chin rest is adjustably extendable and retractable. The chin rest may also be adjustably extendable and retractable independent of the fingerboard and the neck.

Certain embodiments of the disclosed subject matter include a retractable stringed musical instrument that further comprises a rack and pinion gear mechanism coupled to the neck. The rack and pinion gear mechanism disposed within the body. A camshaft disposed within the body and disposed between the rack and pinion gear mechanism and the tailpiece. The rack and pinion gear mechanism configured to transmit movement of the fingerboard and neck to the camshaft.

Certain embodiments of the disclosed subject matter include a retractable stringed musical instrument that further comprises a translating follower coupled to the bridge and coupled to a groove of the camshaft, where the groove of the camshaft configured to transmit movement of the camshaft to the bridge. Certain embodiments of the disclosed subject matter include a retractable stringed musical instrument that further comprises at least one spring coupled to the camshaft. The at least one spring disposed within the body disposed between the camshaft and the tailpiece, where the at least one spring configured to compress and expand.

Certain embodiments of the disclosed subject matter include a retractable stringed musical instrument comprising a body having a first end, a second end, a first face, a second face, a first side and a second side, a tailpiece having a first end, a second end, a first face, a second face, a first side and a second side, the first end of the tailpiece coupled to the first end of the body defining a tailpiece end of the instrument, a neck having a playing face and a back face and a fingerboard having a playing face and a back face. The back face of the fingerboard coupled to the playing face of the neck. The neck coupled to the second end of the body defining a head end of the instrument. The playing face of the fingerboard faces a same direction as the first face of the body defining a playing face of the instrument, and the back face of the neck faces a same direction as the second face of the body defining a back face of the instrument. The fingerboard and the neck configured to adjustably retract in a first direction towards the tailpiece end of the instrument defining a retracted position and extend in a second direction away from the tailpiece end defining an extended position. At least a portion of the neck disposed within the body in the retracted position. The retractable stringed instrument further comprises a bridge coupled to the body where the bridge disposed above the playing face of the body in the extended position and configured to move towards the back face of the instrument upon retraction.

Certain embodiments of the disclosed subject matter include a retractable stringed musical instrument where the plurality of strings comprises one of an auxetic material or material following Hooke's law.

Certain embodiments of the disclosed subject matter include a retractable stringed musical instrument where the fingerboard comprises at least one of steel, aluminum or wood.

Certain embodiments of the disclosed subject matter include a retractable stringed musical instrument where the plurality of strings comprises one of an auxetic material or auxetic characteristics.

Certain embodiments of the disclosed subject matter include a retractable stringed musical instrument where the retractable stringed musical instrument comprises an instrument that uses strings including one of a guitar, a violin, a cello, a viola, a double bass, or a mandolin.

Certain embodiments of the disclosed subject matter include a method for retracting and extending a stringed musical instrument. The stringed musical instrument comprises a tailpiece, a body coupled to the tailpiece, a neck coupled to the body, a fingerboard coupled to the neck, and a bridge coupled to the body. The body disposed between the tailpiece and the fingerboard and the neck. The method comprises sliding the fingerboard and the neck towards the tailpiece so that at least a portion of the neck moves within the body of the stringed musical instrument during retraction and the bridge moves vertically to enable the fingerboard to move over the bridge during retraction. The method further comprises sliding the fingerboard and the neck away from the tailpiece so that at least a portion of the neck moves outside the body of the stringed musical instrument during extension and the bridge moves vertically to enable the fingerboard to move over the bridge during extension.

DETAILED DESCRIPTION

Figure 1:
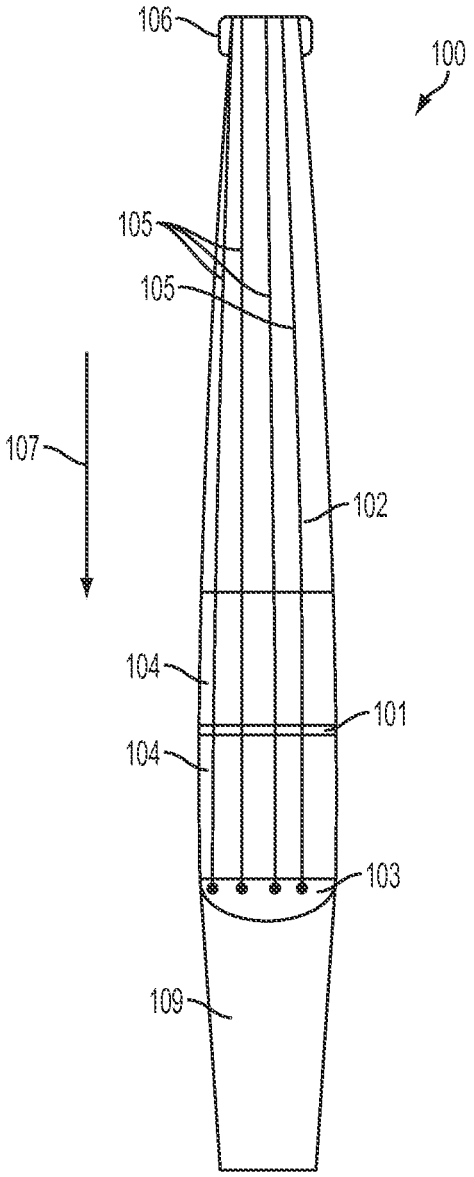
FIG. 1 illustrates a stringed musical instrument with a fully extended fingerboard in accordance with some embodiments of the disclosed subject matter.

In the following description, specific details are set forth regarding the disclosed subject matter and the manner in which the subject matter may operate, etc., in order to provide a thorough understanding of the disclosed subject matter. It will be apparent, however, to one skilled in the art that the disclosed subject matter may be practiced without such specific details. In other instances, well-known components, structures, and techniques have not been shown in detail to avoid unnecessarily obscuring the subject matter. It should be understood that these examples are exemplary. It is contemplated that there are other methods and systems that are within the scope of the disclosed subject matter. Also, the same reference numerals are used in the drawings and in the description to refer to the same elements to simplify the description.

The disclosed subject matter relates to a retractable stringed musical instrument. More specifically, the disclosed subject matter relates to a retractable stringed instrument that can be retracted into a smaller form factor that eases transportation. The disclosed subject matter is directed to stringed musical instruments, including, but not limited to, violas, cellos, violins, double basses, guitars, or mandolins. Those of ordinary skill in the art will understand that the disclosed subject matter is not limited to the instruments named above and can be applied to any type of stringed musical instrument that produces sound by being, plucked, bowed, or struck whether acoustic or electric.

The disclosed subject matter relates to a stringed musical instrument, which allows for maximum portability. In some embodiments of the disclosed subject matter, the stringed musical instrument may be a violin having at least a fingerboard, a tailpiece, a bridge, a body, a neck and a chin rest. The violin can be reduced in size when the fingerboard slides towards the tail of the instrument to compress the size of the instrument thereby allowing for maximum portability. When the stringed musical instrument is in its extended position, the components are in their conventional positions, as is known by one of skill in the art. When the instrument is moved to a retracted position, the fingerboard slides towards the tail of the instrument. In the fully retracted position, the fingerboard of the stringed musical instrument is located above the bridge and the body of the instrument. When the fingerboard slides towards the tail of the instrument, the neck of the instrument also moves towards the tail of the instrument and slides into the body of the instrument. In some embodiments of the disclosed subject matter, the chin rest of the stringed instrument can also be refracted into or alongside a tailpiece of the instrument. The stringed musical instrument can have the capability of expanding to a full size instrument such that the bridge and body of the instrument can slide out from underneath the fingerboard to return to the conventional position. In other embodiments of the disclosed subject matter, the bridge of the instrument can move vertically to allow the sliding fingerboard to slide over the body of the instrument. The movement of the bridge can be coupled to a sliding mechanism housed within the body of the instrument and coupled to the fingerboard section of the instrument so that the bridge is lowered when the instrument is in the retracted position and raised as the instrument is moved to the extended position.

In accordance with some embodiments of the disclosed subject matter, a tuning mechanism of the stringed musical instrument uses cittern-style tuning pegs, whereby tension of the strings is dictated by clockwise and counter-clockwise motion of the cittern-style tuning pegs. In some embodiments of the disclosed subject matter, the strings are coupled to a retraction mechanism in addition to the tuning pegs where the retraction mechanism stores the excess length of the strings created when the fingerboard of the instrument is retracted. Upon extension of the instrument, the strings can extend from the retraction mechanism. In some embodiments of the disclosed subject matter, the retraction mechanism uses spring-based technology. Those of ordinary skill in the art will recognize that other technologies can be used for the retraction mechanism.

In accordance with some embodiments of the disclosed subject matter, the stringed musical instrument can be an acoustic musical instrument or an electric musical instrument. In some embodiments of the disclosed subject matter, the acoustic instrument will have a hollow body, a soundpost, and a bass bar, located within the area of the camshaft block similar to a typical acoustic instrument, as it is understood by those of skill in the art. In other embodiments of the disclosed subject matter, electric amplification can be achieved by either magnetic or piezoelectric amplification. Magnetic amplification operates based on the vibrations of soft-magnetic or ferrous strings. For magnetic amplification, the amplifier can be coupled to the fingerboard side of the instrument or can be installed in the body. Piezoelectric amplification operates by pressure-based transduction whereby string vibrations are converted to electrical impulses. The amplifier can be coupled underneath the bridge and can be used in conjunction with magnetic pickups to provide a wider range of sounds. In some embodiments of the disclosed subject matter, a dual piezo pickup system can be used, whereby one pickup can be coupled under the bridge and one pickup can be coupled under the body. In other embodiments of the disclosed subject matter, a wireless or wired connection can be used to connect the instrument to an amplifier. In yet other embodiments of the disclosed subject matter, the instrument can be coupled to a portable amplifier, for example, the Wowee One speaker available from Wowee One. In still further embodiments of the disclosed subject matter, the natural conductivity of the body can be used to pass the electric signal from the instrument to a platform that acts as a transducer via a pair of shoes.

The disclosed subject matter relates to a retractable stringed musical instrument comprising a body, a tailpiece coupled to the body, a fingerboard coupled to the body and tailpiece, the fingerboard extending in one direction from the tailpiece, wherein the fingerboard being adjustably extendable and retractable relative to said tailpiece and wherein the fingerboard being located above the bridge and body when the instrument is in a retracted position, a neck coupled to the fingerboard wherein the neck being located inside the body when the instrument is in the retracted position, a bridge coupled to the body, wherein the bridge moving vertically when the instrument is moved to the retracted position to enable the fingerboard to move over the bridge.

Referring now to the drawings, and initially to FIG. 1, there is illustrated a stringed musical instrument in the playing or extended position in accordance with some embodiments of the disclosed subject matter. Specifically, as illustrated, the musical instrument 100 depicted is a violin. As shown, the musical instrument 100 has a fingerboard 102, a body 104, a plurality of strings 105, a bridge 101, a string stay 103, a tailpiece 109, and a string retraction mechanism with tuning pegs 106. As will be illustrated and further explained, the fingerboard 102 slides in the direction of arrow 107 when the fingerboard 102 of the musical instrument 100 is retracted towards the tailpiece 109 of the musical instrument 100. In addition to traditional strings that follow Hooke's Law since they become thinner as they are stretched, strings made of an Auxetic material that incur the opposite effect by getting thicker as they expanded could facilitate the operation of the musical instrument.

Figure 10:
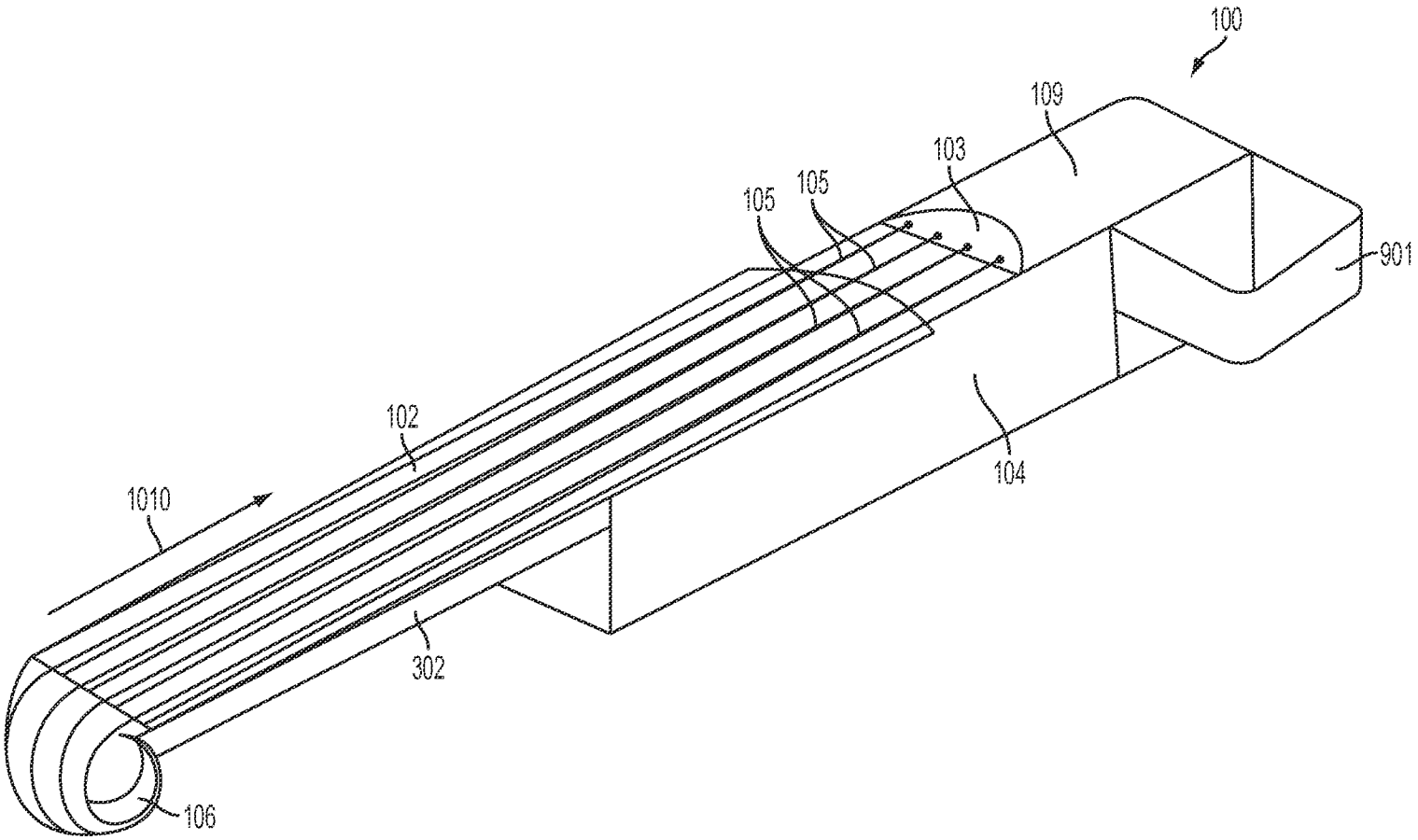
FIG. 10 is a side view of a stringed musical instrument with an extended fingerboard in accordance with some embodiments of the disclosed subject matter.

FIG. 10 provides a perspective view of the musical instrument 100 in the extended position in accordance with some embodiments of the disclosed subject matter. As illustrated in FIG. 10, the fingerboard 102 is directly coupled to a neck 302. The fingerboard 102 and the neck 302 slide in the direction of arrow 1010 when the musical instrument 100 is retracted.

In accordance with some embodiments of the disclosed subject matter, the fingerboard 102 and neck 302 can be made from aluminum. In another embodiment of the disclosed subject matter, the fingerboard 102 and neck 302 can be made from steel. Indeed, fingerboards and necks can be made from a variety of materials known to those of ordinary skill in the art, including, but not limited to, aluminum, steel, maple wood, and other types of wood. In further embodiments of the disclosed subject matter, the plurality of strings 105 can be traditional strings that follow Hooke's Law and become thinner as they are stretched to the point of fatigue. The plurality of strings 105 can also be made of an Auxetic material that incur the opposite effect to traditional strings by getting thicker as they are expanded.

Figure 2:
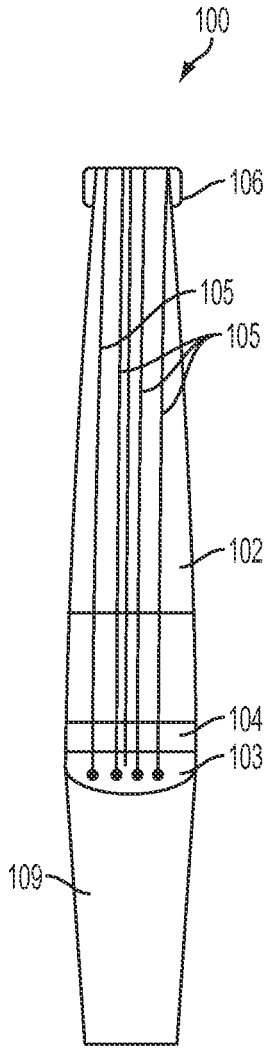
FIG. 2 illustrates a stringed musical instrument with a retracted fingerboard in accordance with some embodiments of the disclosed subject matter.
Figure 3:
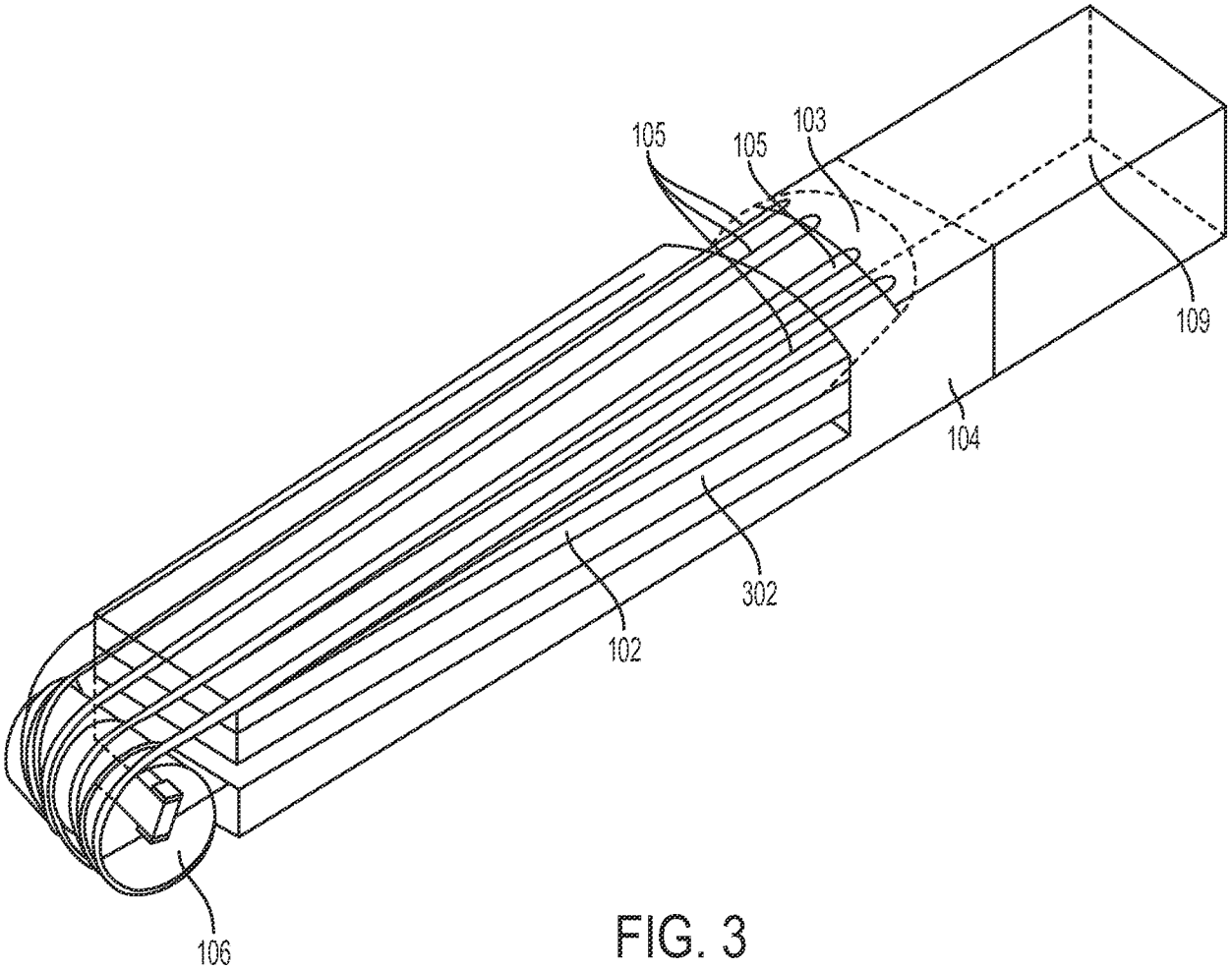
FIG. 3 is a side view of a stringed musical instrument with a retracted fingerboard in accordance with some embodiments of the disclosed subject matter.

FIGS. 2 and 3 show a stringed musical instrument in a retracted position in accordance with some embodiments of the disclosed subject matter. In the refracted position, the body 104 and the bridge 101 are housed behind the fingerboard 102. In one embodiment of the disclosed subject matter, the instrument 100 can be retracted by, among others, moving the fingerboard 102 laterally from the position shown in FIG. 1 to the position shown in FIG. 2. As shown in FIG. 3, in the retracted position, the neck 302, coupled to the fingerboard 102, slides into the body 104.

Figure 7A:
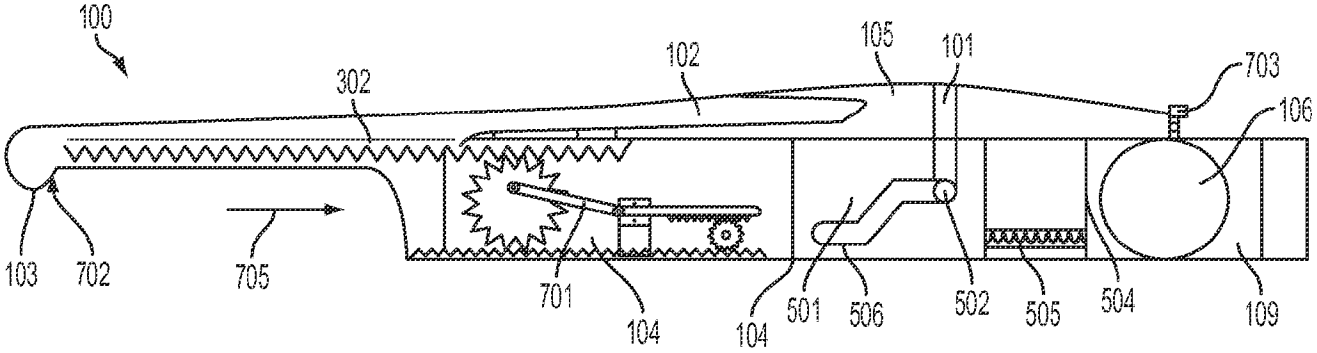
FIG. 7A is a longitudinal cross-section view of a stringed musical instrument with a fully extended fingerboard in accordance with some embodiments of the disclosed subject matter.
Figure 7B:
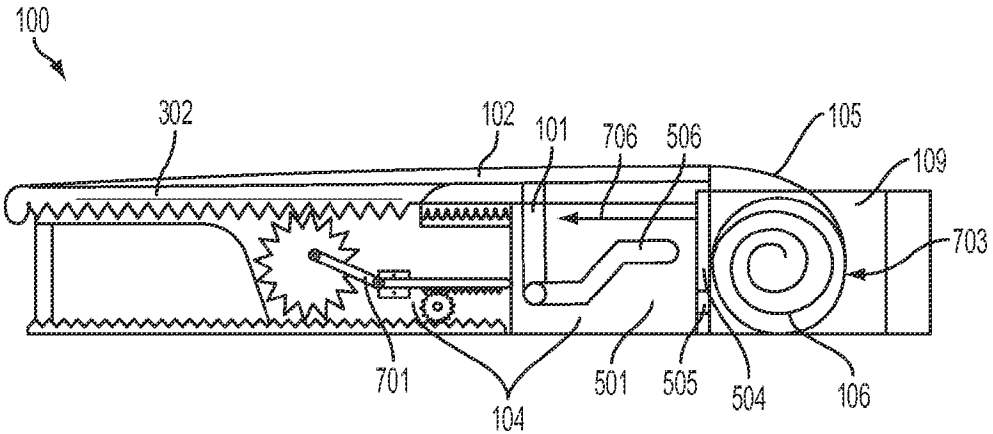
FIG. 7B is a longitudinal cross-section view of a stringed musical instrument with a fully retracted fingerboard in accordance with some embodiments of the disclosed subject matter.
Figure 8A:
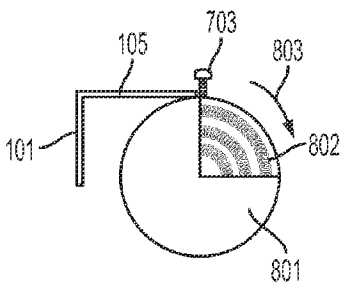
FIGS. 8A-G are side views of a string retraction mechanism of a stringed musical instrument when a fingerboard of the stringed musical instrument is in different positions in accordance with some embodiments of the disclosed subject matter.
Figure 8B:
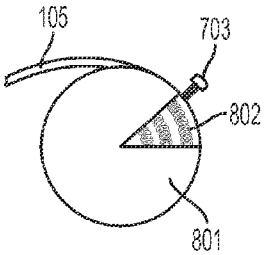
Figure 8C:
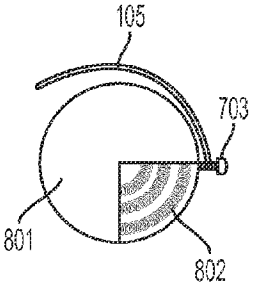
Figure 8D:
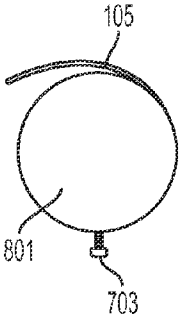
Figure 8E:
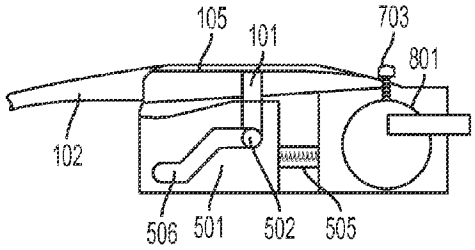
Figure 8F:
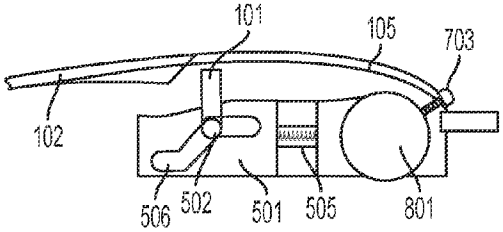
Figure 8G:
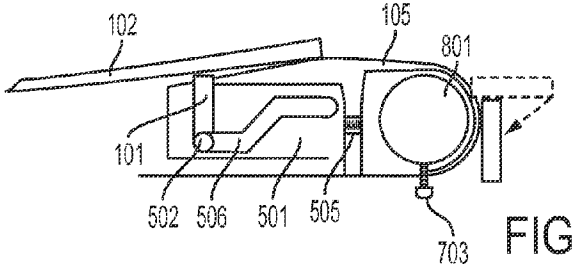
Figure 8H:
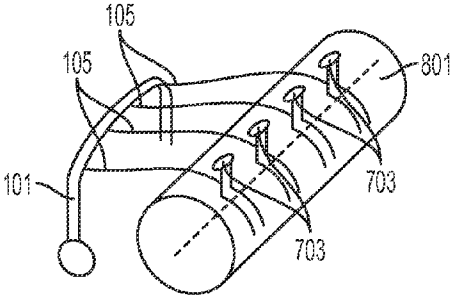
FIG. 8H is a side perspective view of a string retraction mechanism of a stringed musical instrument in accordance with some embodiments of the disclosed subject matter.

In accordance with some embodiments of the disclosed subject matter, FIGS. 7A-B provide longitudinal cross-section views of the stringed musical instrument 100 in an extended playing position (FIG. 7A) and in a retracted position (FIG. 7B). FIGS. 7A-B depict how the instrument can be retracted from an extended position in FIG. 7A to a retracted position in FIG. 7B. For example, there is shown the components for retraction. These components include a rack and pinion gear mechanism 701 located within the body 104 and coupled to the fingerboard 102 and the neck 302. The rack and pinion gear mechanism 701 is coupled to a camshaft 501, which is located within the body 104. The bridge 101 is coupled to a translating follower 502, which is coupled to the groove of the camshaft 506.

With continued reference to FIG. 7A, to retract the stringed musical instrument 100, the fingerboard 102 slides in the direction of arrow 705. In accordance with one embodiment of the disclosed subject matter, a user of the stringed musical instrument 100 can generate the force used to slide the fingerboard 102 by hand. The lateral movement of the fingerboard 102 causes the lateral movement of the neck 302 and the rack and pinion gear mechanism 701 to which it is coupled.

Figure 4A:
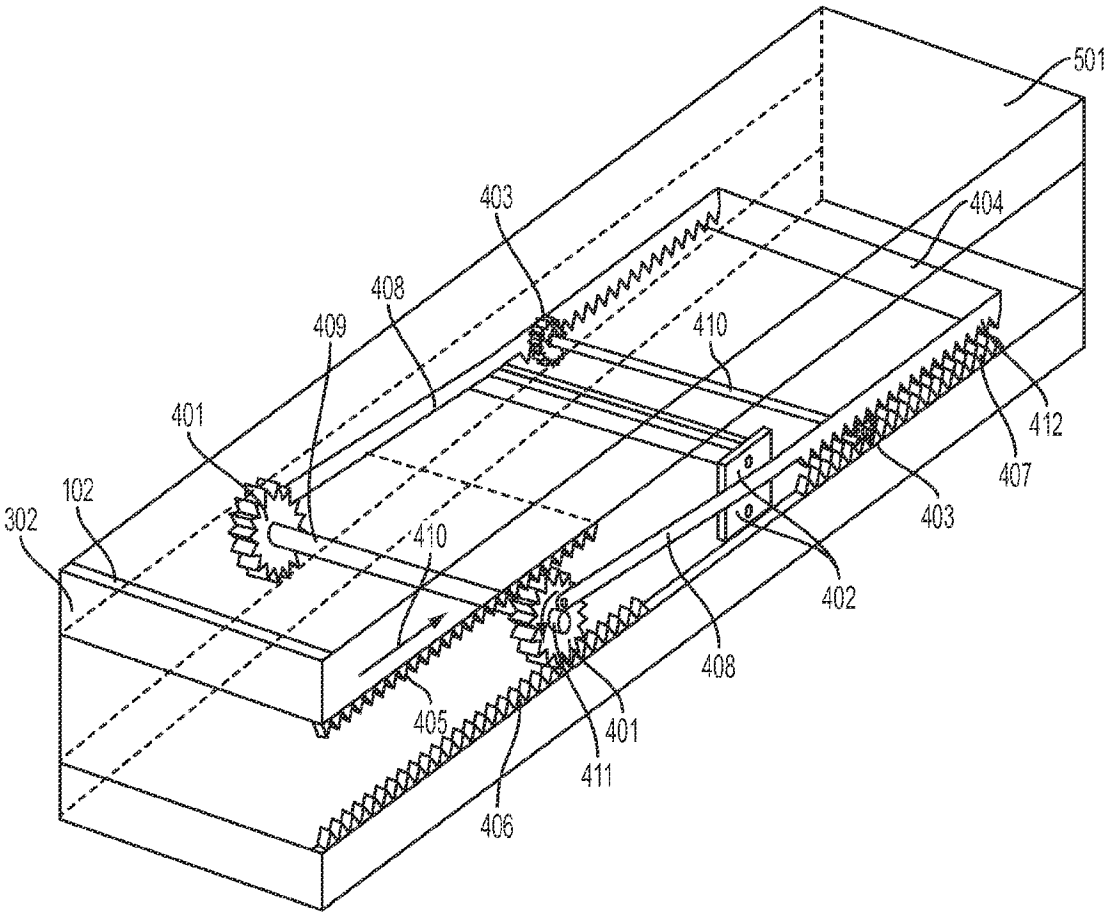
FIG. 4A is a transparent view of a portion of the body of a stringed musical instrument showing a fingerboard retraction mechanism in accordance with some embodiments of the disclosed subject matter.
Figure 4B:
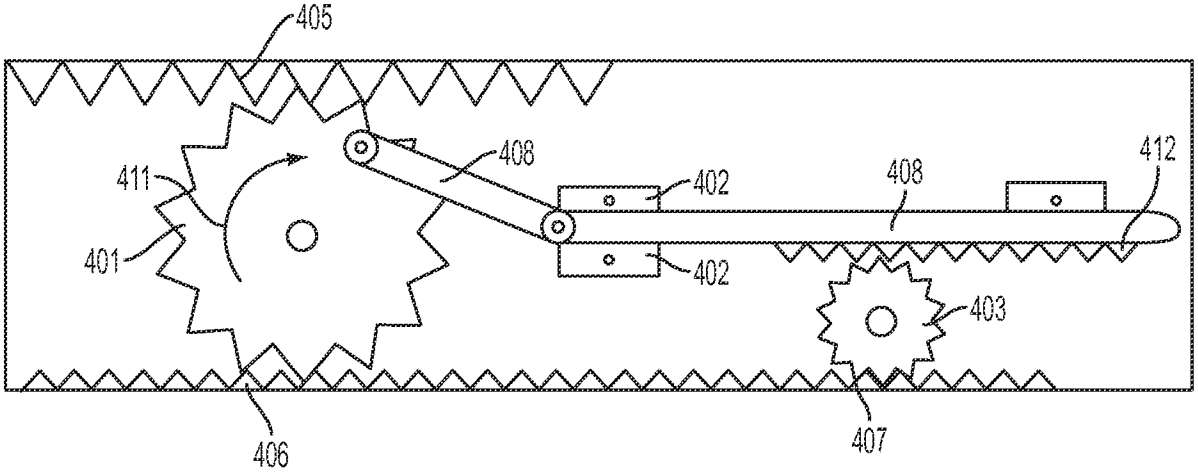
FIG. 4B is a transparent side view of a portion of the body of a stringed musical instrument showing a fingerboard retraction mechanism in accordance with some embodiments of the disclosed subject matter.

FIGS. 4A-B show a transparent view of a portion of the body 104 containing the rack and pinion mechanism 701 while the stringed musical instrument 100 is in the extended position in accordance with some embodiments of the disclosed subject matter. Specifically, FIGS. 4A-B depict the rack and pinion gear mechanism 701 that translates the movement of the fingerboard 102 and neck 302 to the camshaft 501 in accordance with one embodiment of the disclosed subject matter. A first dual pinion formation 401 is coupled to a first top rack 405 and a first bottom rack 406. The first top rack 405 can be part of, or directly coupled to, the neck 302. The first pinions 401 are coupled by a shaft 409 to maintain parallel alignment. Each first pinion 401 is coupled to drive shafts 408. A second dual pinion formation 403 is coupled to a second bottom rack 407 and to the drive shafts 408 as a second top rack 412. The second dual pinions 403 are coupled by a second shaft 410 to maintain parallel alignment. The drive shafts 408 are coupled by a bar 404 at the end opposing the first dual pinions 401. In accordance with one embodiment of the disclosed subject matter, the first dual pinions 401 are larger in diameter than the second dual pinions 403. It should be understood by a person skilled in the art that various sizes and configurations can be used for the rack and pinion gear mechanism 701. The lateral movement of the fingerboard 102 and neck 302, which is directly coupled to the first top rack 405, causes the first dual pinions 401 to rotate in the direction of arrow 411 as illustrated in FIGS. 4A-B. The first dual pinions 401 and attached drive shafts 408 move linearly in the direction of arrow 410 along the first bottom stationary rack 406. Guide blocks 402, which create a channel for the drive shafts 408 to travel through, guide the lateral movement of the drive shafts 408. The lateral movement of the drive shafts 408 is transmitted to the second dual pinion formation 403, which is coupled to the second bottom stationary rack 407. As the drive shafts 408 move laterally in the direction of arrow 410 the bar 404 at the end of the drive shafts 408 couples with the cam shaft 501 and transmits the linear motion to the camshaft 501. In one embodiment of the disclosed subject matter, the drive shafts 408 can be made from separate pieces that are coupled, as shown in FIG. 4B. In another embodiment of the disclosed subject matter, the first bottom rack 406 and the second bottom rack 407 can be made from a single bottom rack as shown in FIG. 4B. The mechanism used to transmit the lateral movement of the fingerboard 102 and neck 302 to camshaft 501 as illustrated in FIGS. 4A-B is not limited to a rack and pinion mechanism as described. Any mechanism that can transmit linear motion in the direction of arrow 410 while maintaining constant tensile load to support the force of the strings could be used and would be known to one of skill in the art.

Figure 5:
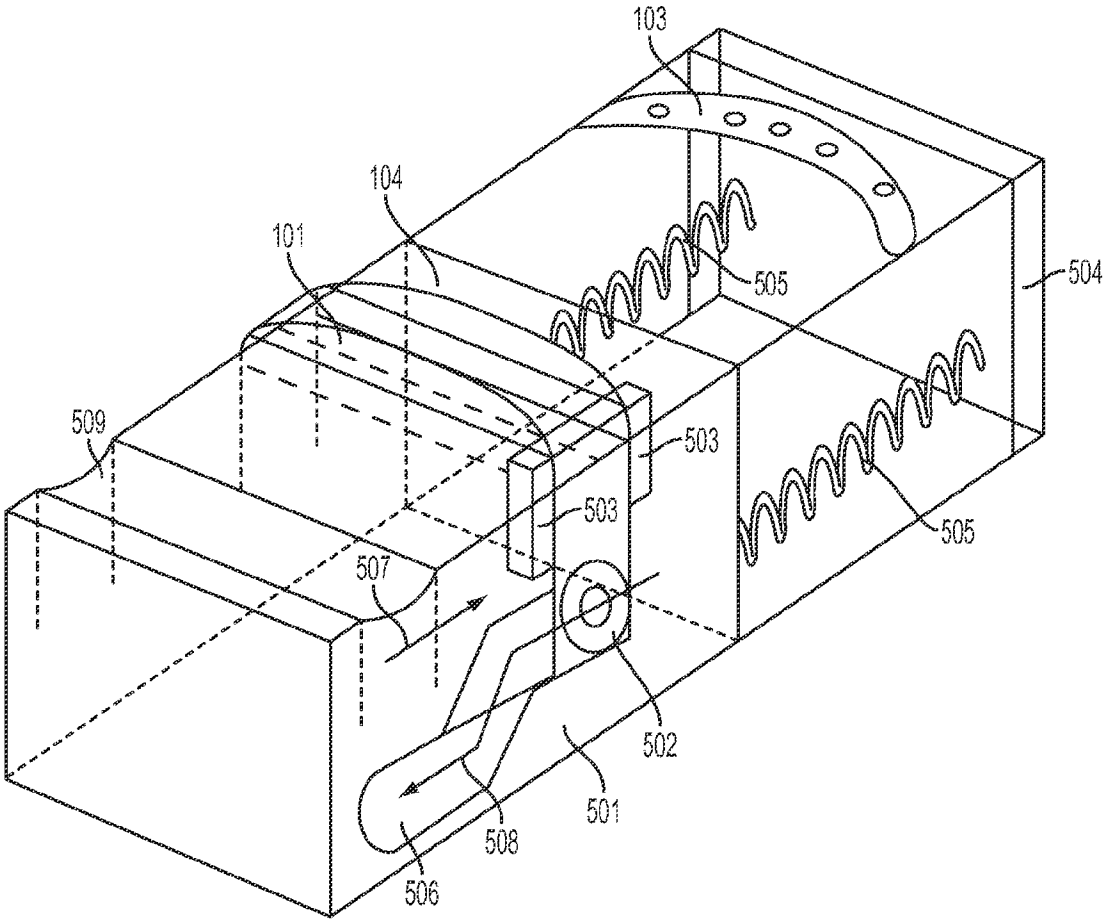
FIG. 5 is a transparent view of a portion of the body of a stringed musical instrument showing a bridge retraction mechanism in accordance with some embodiments of the disclosed subject matter.
Figure 6B:
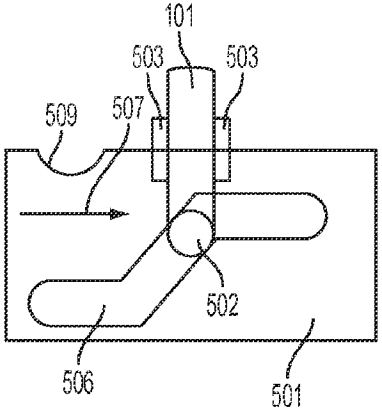
FIGS. 6A-C are longitudinal cross-section views of a portion of the body of a stringed musical instrument showing a bridge retraction mechanism when a fingerboard of the stringed instrument is moved from a fully extended position to a retracted position in accordance with some embodiments of the disclosed subject matter.
Figure 6A:
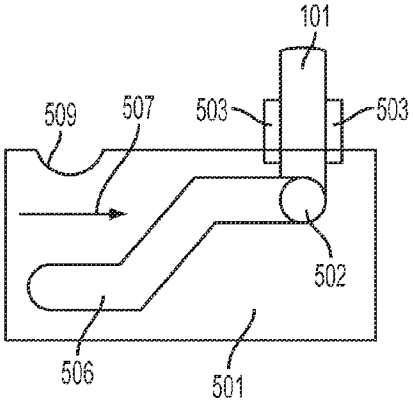
Figure 6D:
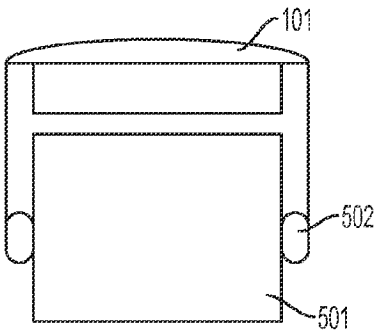
FIG. 6D is a transverse cross-section view of a bridge of a stringed musical instrument in accordance with some embodiments of the disclosed subject matter.
Figure 6C:
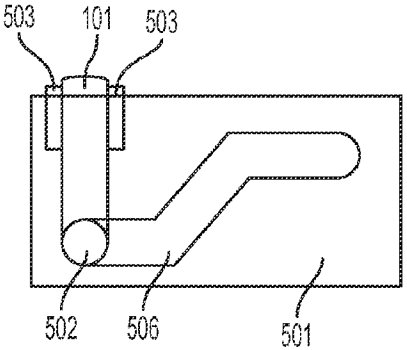

FIG. 5 shows a transparent view of a portion of the body 104 containing the camshaft 501 while the instrument is in the extended position in accordance with some embodiments of the disclosed subject matter. The bridge 101 is directly coupled to a translating follower 502, which is coupled to groove 506 of the camshaft 501. In order to retract the instrument, the lateral movement generated by fingerboard 102 is transmitted to the camshaft 501. Referring to FIGS. 5 and 6A-C, as the camshaft 501 moves in the direction of arrow 507, the translating follower 502 follows the path of groove 501 causing the bridge 101 to move along the path indicated by arrow 508 and downward into groove 509. In the retracted position (FIG. 6C), the bridge 101 is at a height that allows the fingerboard 102 to continue moving laterally towards the tail of the instrument as it passes the location of the bridge 101. Guide blocks 503, which create a channel for the vertical movement of the bridge 101, guide the vertical movement of the bridge 101. When the instrument 100 is in its extended form, the bridge 101 is not flush with the body 104 (FIGS. 6A and 6D).

As can be seen in FIGS. 7A-B and FIG. 5, at the end of the camshaft 501 nearest the tail of the instrument, the camshaft 501 is coupled to springs 505 which extend between the camshaft 501 and block 504 in accordance with some embodiments of the disclosed subject matter. Block 504 separates the body of the instrument from the tailpiece 109. As the camshaft 501 moves laterally towards the tail of the instrument, springs 505 are compressed. Now referring to FIG. 7B, when the instrument is expanded from its retracted position, springs 505 can expand and provide force to propel the camshaft 501 in the direction of arrow 706. The movement of the camshaft 501 causes the bridge 101 to ascend. The force provided by the expansion of the springs 505 allows the bridge 101 to ascend and oppose any downward force experienced by the bridge 101 by its coupling with the plurality of strings 105.

Now referring again to FIG. 1, a plurality of strings 105 extend from the string stay 103 to the string retraction mechanism with tuning pegs 106, running parallel with the fingerboard 102. The location of the string stay 103 and the string retraction mechanism with tuning pegs 106 can be reversed, as shown in FIGS. 7A-B, so that the string retraction mechanism with tuning pegs 106 are located in the tailpiece 109 and the string stay 103 is located at the head end of the fingerboard 102. In one embodiment of the disclosed subject matter, the movement generated by the string retraction mechanism with tuning pegs 106 can provide the force for retraction of the stringed musical instrument.

Returning now to FIG. 7A, which shows a longitudinal cross-section view of the stringed musical instrument 100 in accordance with some embodiments of the disclosed subject matter, to explain the arrangement of the plurality of strings 105. When the stringed musical instrument 100 is in the extended or in playing position, the plurality of strings 105 are under tension and contact the top surface of the bridge 101, while remaining a small distance above the fingerboard 102 as those of ordinary skill in the art will recognize. The plurality of strings 105 have a ball or loop 702 at one end, which allows them to be secured in slots or holes of the string stay 103. The plurality of strings 105 are secured at the opposite end by tuning pegs 703. Specifically, the plurality of strings 105 are secured by winding the end of one of the strings around one of the tuning pegs 703. The plurality of strings 105 are under tension, which is maintained and adjusted by the clockwise and counter-clockwise motion of the tuning pegs 703. In one embodiment in accordance with some embodiments of the disclosed subject matter, the tuning pegs 703 can be cittern-style tuning pegs. Those of ordinary skill in the art will recognize that other mechanisms can be used to secure the strings and adjust their tuning or tension.

Now referring to FIGS. 8A-H, which show the string retraction mechanism 801 of the stringed musical instrument in accordance with some embodiments of the disclosed subject matter. Upon the retraction of the musical instrument 100, an excess length of the plurality of strings 105 is created. As shown in FIGS. 8A-H, the plurality of strings 105 are directly coupled to the tuning pegs 703 which are directly coupled to a retraction mechanism 801 in accordance with some embodiments of the disclosed subject matter. The refraction mechanism 801 can use a spring-based technology to rotate in order to store the excess length of the plurality of strings 105 while maintaining constant tension. When the musical instrument 100 is in its extended form (FIG. 8A), a spring 802 within the retraction mechanism 801 is extended. A locking feature can be used to lock the spring 802 into position in the extended position and prevent the spring 802 from exerting any force. Upon retraction of the musical instrument 100, the spring lock is released and the tension in the plurality of strings 105 is reduced allowing the spring 802 to compress and retract. The spring 802 is coupled to the retraction mechanism 801 in a manner that causes rotational movement of the retraction mechanism 801 in the direction of arrow 803. The excess length of the plurality of strings 105 is wrapped around the retraction mechanism 801, as shown in FIGS. 8A-D. Upon extension of the musical instrument 100, the plurality of strings exert tension on the retraction mechanism 801, which moves in the opposite direction of arrow 803 and causes the spring 802 to be extended. The locking feature is engaged to hold the retraction mechanism 801 in the extended position. Those of ordinary skill in the art will recognize that other technologies can be used for the retraction mechanism 801 including, but not limited to, a spring loaded lock or a retractable belt.

Figure 9C:
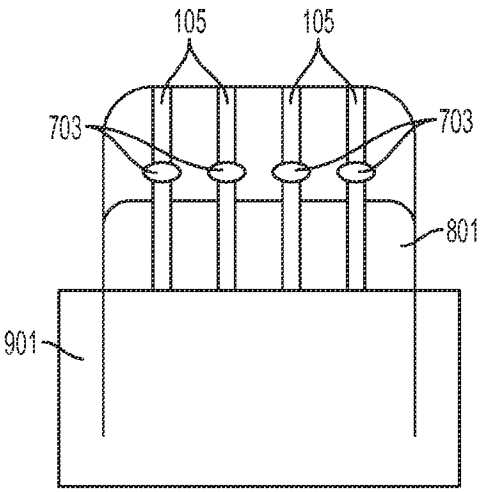
FIGS. 9A-C are end views of a chin rest of a stringed musical instrument in different positions in accordance with some embodiments of the disclosed subject matter.
Figure 9B:
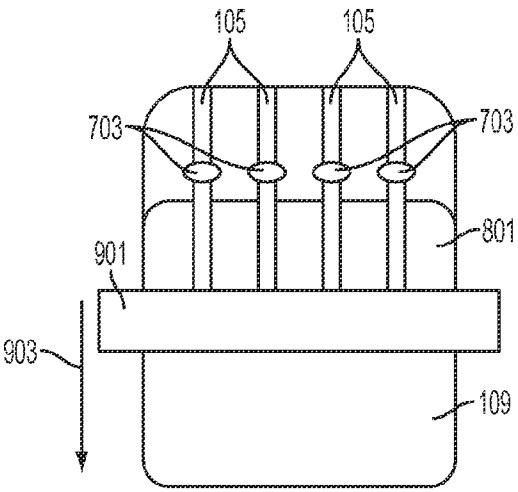
Figure 9A:
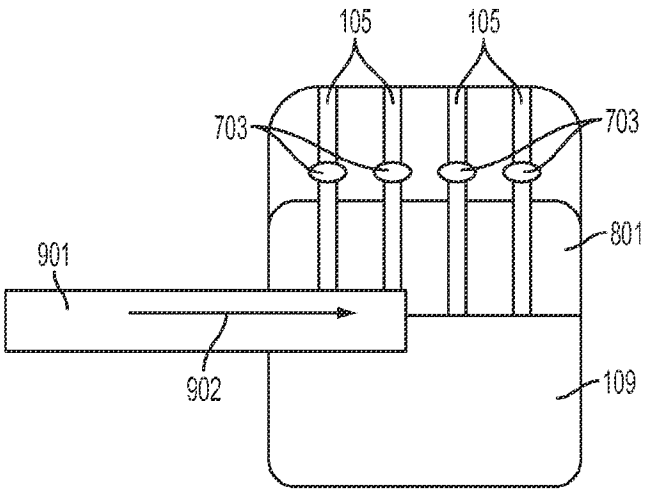

As illustrated in FIGS. 9A-C, a chin rest 901 of the musical instrument 100 can be retracted alongside the tailpiece 109 in accordance with some embodiments of the disclosed subject matter. The chin rest 901 can be retracted independently from the rest of the musical instrument 100. When the musical instrument 100 is in its extended form, the chin rest is extended from the tailpiece 109 as shown in FIG. 9A. In order to retract the chin rest 901, it slides first in the direction of arrow 902 to the midpoint position shown in FIG. 9B. The chin rest 901 is then folded down in the direction of arrow 903 about the end of the tailpiece 109 to the position shown in FIG. 9C. Those of ordinary skill in the art will recognize that there are a variety of mechanisms and designs that can be used to achieve movement of the chin rest.

The disclosed subject matter is not limited in its application to the arrangements of the components set forth in the description or illustrated in the drawings. The disclosed subject matter is capable of other embodiments and of being practiced and carried out in various ways. Also, it is to be understood that the phraseology and terminology employed herein are for the purpose of description and should not be regarded as limiting. Moreover, certain features, which are well known in the art, are not described in detail in order to avoid obscuring the description of the disclosed subject matter.

As such, those skilled in the art will appreciate that the conception, upon which this disclosure is based, may readily be utilized as a basis for the designing of other musical instruments for carrying out the several purposes of the present disclosed subject matter. It is important, therefore, that the disclosed subject matter be regarded as including equivalent structures to those described herein insofar as they do not depart from the spirit and scope of the present disclosed subject matter.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present disclosure.

Although the present disclosure has been described and illustrated in the foregoing example embodiments, it is understood that the present disclosure has been made only by way of example, and that numerous changes in the details of implementation of the disclosure may be made without departing from the spirit and scope of the disclosure, which is limited only by the claims which follow. Features of the disclosed embodiments can be combined and rearranged in various ways within the scope and spirit of the disclosure. Other uses of the disclosed embodiments are within the following claims. For example, the disclosed embodiments can be used for any stringed musical instrument in addition to a violin.

What is claimed:

1. A retractable stringed musical instrument comprising:
a tailpiece;
a body coupled to the tailpiece;
a neck coupled to the body;
a fingerboard coupled to the neck, wherein the fingerboard and the neck adjustably extendable and retractable relative to the tailpiece, wherein the body disposed between the tailpiece and the fingerboard and the neck, and wherein at least a portion of the neck disposed within the body in a retracted position; and
a bridge coupled to the body wherein the bridge being vertically movable upon retraction of the fingerboard and the neck to enable the fingerboard to move over the bridge.

2. The retractable stringed musical instrument of claim 1, further comprising:
at least one tuning peg;
a string stay; and
a plurality of strings distended between the tailpiece and the fingerboard, the plurality of strings coupled to the tuning peg and the string stay.

3. The retractable stringed musical instrument of claim 2, wherein the string stay coupled to the fingerboard or neck and wherein the at least one tuning peg coupled to the tailpiece.

4. The retractable stringed musical instrument of claim 2, wherein the string stay coupled to the tailpiece and wherein the at least one tuning peg coupled to the fingerboard or the neck.

5. The retractable stringed musical instrument of claim 2, further comprising:
a string retraction mechanism for storing an excess length of at least one of the plurality of strings created upon retraction of the fingerboard and the neck.

6. The retractable stringed musical instrument of claim 1, further comprising:
a chin rest coupled to the tailpiece.

7. The retractable stringed musical instrument of claim 6, wherein the chin rest adjustably extendable and retractable.

8. The retractable stringed musical instrument of claim 7, wherein the chin rest adjustably extendable and retractable independent of the fingerboard and the neck.

9. The retractable stringed musical instrument of claim 1, further comprising:
a rack and pinion gear mechanism coupled to the neck, the rack and pinion gear mechanism disposed within the body,
a camshaft disposed within the body and disposed between the rack and pinion gear mechanism and the tailpiece,
the rack and pinion gear mechanism configured to transmit movement of the fingerboard and neck to the camshaft.

10. The retractable stringed musical instrument of claim 9, further comprising:
a translating follower coupled to the bridge and coupled to a groove of the camshaft, wherein the groove of the camshaft configured to transmit movement of the camshaft to the bridge.

11. The retractable stringed musical instrument of claim 10, further comprising:
at least one spring coupled to the camshaft, the at least one spring disposed within the body disposed between the camshaft and the tailpiece, wherein the at least one spring configured to compress and expand.

12. A retractable stringed musical instrument comprising:
a body having a first end, a second end, a first face, a second face, a first side and a second side;
a tailpiece having a first end, a second end, a first face, a second face, a first side and a second side, the first end of the tailpiece coupled to the first end of the body defining a tailpiece end of the instrument;
a neck having a playing face and a back face;
a fingerboard having a playing face and a back face, the back face of the fingerboard coupled to the playing face of the neck, wherein the neck coupled to the second end of the body defining a head end of the instrument, and wherein the playing face of the fingerboard faces a same direction as the first face of the body defining a playing face of the instrument, and the back face of the neck faces a same direction as the second face of the body defining a back face of the instrument, and wherein the fingerboard and the neck configured to adjustably retract in a first direction towards the tailpiece end of the instrument defining a retracted position and extend in a second direction away from the tailpiece end defining an extended position, and wherein at least a portion of the neck disposed within the body in the retracted position; and a bridge coupled to the body wherein the bridge disposed above the playing face of the body in the extended position and configured to move towards the back face of the instrument upon retraction.

13. The retractable stringed musical instrument of claim 12, further comprising:

at least one tuning peg;

a string stay, wherein the at least one tuning peg coupled to the tailpiece and the string stay coupled to the fingerboard or the neck, or wherein the at least one tuning peg coupled to the fingerboard or neck and the string stay coupled to the tailpiece, and;

at least one string distended along the playing face of the instrument disposed between the tailpiece end of the instrument and the head end of the instrument and coupled to the at least one tuning peg and the string stay.

14. The retractable stringed musical instrument of claim 13, further comprising:

a string retraction mechanism for storing an excess length of at least one of the plurality of strings created upon retraction of the fingerboard and the neck.

15. The retractable stringed musical instrument of claim 12, further comprising:

a chin rest coupled to the tailpiece.

16. The retractable stringed musical instrument of claim 15, wherein the chin rest is adjustably extendable and retractable.

17. The retractable stringed musical instrument of claim 16, wherein the chin rest being adjustably extendable and retractable independent of the fingerboard and the neck.

18. The retractable stringed musical instrument of claim 12, further comprising:

a rack and pinion gear mechanism coupled to the back face of the neck and disposed within the body, a camshaft disposed within the body and disposed between the rack and pinion gear mechanism and the tailpiece end of the instrument, wherein the rack and pinion gear mechanism configured to transmit movement of the fingerboard and neck to the camshaft.

19. The retractable stringed musical instrument of claim 18, wherein the camshaft configured to move towards the tailpiece end of the instrument.

20. The retractable stringed musical instrument of claim 18, further comprising:

a translating follower coupled to the bridge and coupled to a groove of the camshaft, wherein the groove of the camshaft configured to transmit movement of the camshaft to a vertical movement of the bridge towards the back face of the instrument.

21. The retractable stringed musical instrument of claim 20, further comprising:

at least one spring coupled to the camshaft, the at least one spring disposed within the body and disposed between the camshaft and the first end of the body, wherein the at least one spring configured to compress and expand.

22. The retractable stringed musical instrument of claim 12, wherein the plurality of strings comprises one of an auxetic material or a material that becomes thinner when stretched.

23. The retractable stringed musical instrument of claim 11, wherein the fingerboard comprises at least one of steel, aluminum or wood.

24. The retractable stringed musical instrument of claim 12, wherein the plurality of strings comprises one of an auxetic material or auxetic characteristics.

25. The retractable stringed musical instrument of claim 1, wherein the retractable stringed musical instrument comprises an instrument that uses strings including one of a guitar, a violin, a cello, a viola, a double bass, or a mandolin.

26. The retractable stringed musical instrument of claim 12, wherein the retractable stringed musical instrument comprises an instrument that uses strings including one of a guitar, a violin, a cello, a viola, a double bass, or a mandolin.

27. A method for retracting and extending a stringed musical instrument, wherein the stringed musical instrument comprises a tailpiece, a body coupled to the tailpiece, a neck coupled to the body, a fingerboard coupled to the neck, and a bridge coupled to the body, wherein the body disposed between the tailpiece and the fingerboard and the neck, the method comprising:

sliding the fingerboard and the neck towards the tailpiece so that at least a portion of the neck moves within the body of the stringed musical instrument during retraction and the bridge moves vertically to enable the fingerboard to move over the bridge during retraction; and sliding the fingerboard and the neck away from the tailpiece so that at least a portion of the neck moves outside the body of the stringed musical instrument during extension and the bridge moves vertically to enable the fingerboard to move over the bridge during extension.

* * * * *

UNITED STATES PATENT AND TRADEMARK OFFICE

CERTIFICATE OF CORRECTION

PATENT NO. : 8,993,862 B2
APPLICATION NO. : 14/204526
DATED : March 31, 2015
INVENTOR(S) : Marc Eugene Anderson It is certified that error appears in the above-identified patent and that said Letters Patent is hereby corrected as shown below:

In the specification

At column 1, line number 50, please delete “refraction” and insert --retraction--
At column 6, line number 20, please delete “refracted” and insert --retracted--
At column 8, line number 47, please delete “refracted” and insert --retracted--

Signed and Sealed this
Thirteenth Day of October, 2015

Michelle K. Lee

Michelle K. Lee
*Director of the United States Patent and Trademark Office*